US011910973B2

(12) United States Patent
Wen et al.

(10) Patent No.: US 11,910,973 B2
(45) Date of Patent: Feb. 27, 2024

(54) DEBRIS COLLECTING BASE STATION, CLEANING ROBOT AND CLEANING SYSTEM

(71) Applicant: SHENZHEN FLY RODENT DYNAMICS INTELLIGENT TECHNOLOGY CO., LTD., Shenzhen (CN)

(72) Inventors: Zhenhua Wen, Shenzhen (CN); Ruijun Yan, Shenzhen (CN)

(73) Assignee: Shenzhen Fly Rodent Dynamics Intelligent Technology Co., Ltd., Guangdong (CN)

( * ) Notice: Subject to any disclaimer, the term of this patent is extended or adjusted under 35 U.S.C. 154(b) by 244 days.

(21) Appl. No.: 17/162,234

(22) Filed: Jan. 29, 2021

(65) Prior Publication Data

US 2022/0117457 A1 Apr. 21, 2022

(30) Foreign Application Priority Data

Oct. 20, 2020 (CN) ..... 202011126897.4

(51) Int. Cl.
*A47L 11/40* (2006.01)

(52) U.S. Cl.
CPC ..... *A47L 11/4025* (2013.01); *A47L 11/4011* (2013.01); *A47L 2201/00* (2013.01); *A47L 2201/02* (2013.01); *A47L 2201/024* (2013.01)

(58) Field of Classification Search
None
See application file for complete search history.

(56) References Cited

U.S. PATENT DOCUMENTS

2010/0011529 A1 1/2010 Won et al.
2016/0166126 A1* 6/2016 Morin ..... A47L 7/0004 15/319

(Continued)

FOREIGN PATENT DOCUMENTS

CN 107205602 A 9/2017
CN 209899274 U 1/2020

(Continued)

OTHER PUBLICATIONS

Translation of KR 20150139732 A (Description) (Year: 2016).*

(Continued)

*Primary Examiner* — Steven M Cernoch
*Assistant Examiner* — Steven Huang
(74) *Attorney, Agent, or Firm* — Rosenberg, Klein & Lee

(57) ABSTRACT

A debris collecting base station cooperates with the cleaning robot. The cleaning robot has a debris outlet for discharging debris. The debris collecting base station includes a base, a debris collecting device, a first communication component and a microcontroller. The base has a debris intake passageway. One end of the debris intake passageway pneumatically interfaces with the debris outlet, the debris collecting device is mounted on the base and is communicated with the end of the debris intake passageway away from the debris outlet. The microcontroller is electrically connected to the first communication component and the debris collecting device, which controls the first communication component to send and receive interactive signals with the cleaning robot and controls working modes of the debris collecting base station based on the interactive signals.

18 Claims, 3 Drawing Sheets

(56) References Cited

U.S. PATENT DOCUMENTS

| | | | | |
|---|---|---|---|---|
| 2016/0183752 | A1* | 6/2016 | Morin | A47L 9/009 15/340.1 |
| 2018/0116478 | A1* | 5/2018 | Lewis | A47L 9/1463 |
| 2019/0212752 | A1* | 7/2019 | Fong | G06V 20/36 |
| 2020/0000301 | A1 | 1/2020 | Morin et al. | |
| 2020/0069139 | A1* | 3/2020 | Johnson | A47L 9/149 |
| 2020/0281428 | A1* | 9/2020 | Buening | A47L 9/2873 |

FOREIGN PATENT DOCUMENTS

| | | | | |
|---|---|---|---|---|
| CN | 110840334 | A | 2/2020 | |
| CN | 110859550 | A | 3/2020 | |
| CN | 111227717 | A | 6/2020 | |
| CN | 111590638 | A | 8/2020 | |
| CN | 111743459 | A | 10/2020 | |
| DE | 202018106517 | U1 * | 4/2020 | |
| EP | 3284383 | A2 * | 2/2018 | A47L 11/292 |
| KR | 20150139732 | A * | 6/2014 | B25J 13/086 |
| WO | 2022083006 | A1 | 4/2022 | |

OTHER PUBLICATIONS

Translation of EP 3284383 A2 (Year: 2018).*
Translation of DE 202018106517 U1 (Year: 2020).*
International Patent Office Official Action issued by Foreign Patent Office dated Aug. 4, 2021, for corresponding Application No. 202011126897.4.
International Patent Office Official Action issued by Foreign Patent Office dated Jan. 4, 2022, for corresponding Application No. 202011126897.4.

* cited by examiner

DEBRIS COLLECTING BASE STATION, CLEANING ROBOT AND CLEANING SYSTEM

CROSS-REFERENCE TO RELATED APPLICATIONS

This application is based upon and claims priority to Chinese Patent Application CN202011126897.4, filed Oct. 20, 2020, the entire contents of which are incorporated herein by reference.

TECHNICAL FIELD

The disclosure relates to the technical field of cleaning robot, in particular to a debris collecting base station, a cleaning robot and a cleaning system.

BACKGROUND

With the technological development of cleaning robots, more and more cleaning robots are equipped with debris collecting base stations. The debris collecting base stations can extract the debris from the cleaning robots and stores the debris therein, so as to prevent the user from manually cleaning the debris carried by the cleaning robot.

However, traditional debris collecting base stations or cleaning robots cannot effectively adjust their own working status based on the debris collection status of the other party to work more reliably, resulting in that undesirable phenomena often occurs. For example, the debris collecting base station is full of debris, but it will continue to extracting debris from cleaning robots, which will lower the debris collection effect and user experience, and cannot meet the requirements of intelligent debris collection.

SUMMARY

There are provided a debris collecting base station, a cleaning robot and a cleaning system according to embodiments of the present disclosure.

According to an aspect of embodiments of the present disclosure, there is provided a debris collecting base station. A debris collecting base station, the debris collecting base station is configured to cooperate with a cleaning robot which has a debris outlet for discharging debris, wherein the debris collecting base station comprises:

a base, provided with a debris intake passageway, wherein one end of the debris intake passageway is configured to pneumatically interface with the debris outlet of the cleaning robot;

a debris collecting device, mounted in the base, wherein the debris collecting device is communicated with another end of the debris intake passageway away from the debris outlet and is configured to extract debris from the cleaning robot and store the extracted debris;

a first communication component, mounted in the base; and a microcontroller, electrically connected to the first communication component and the debris collecting device, and configured to control the first communication component to send and receive interactive signals with the cleaning robot and control an working mode of the debris collecting base station based on the interactive signals.

According to another aspect of embodiments of the present disclosure, there is provided a cleaning robot. A cleaning robot configured to cooperate with a debris collecting base station, wherein comprises:

a housing, comprising a receiving cavity;

a debris bin, mounted in a preset position of the receiving cavity, wherein the debris bin is provided with a debris outlet, and the debris bin can discharge debris to the debris collecting base station through the debris outlet;

a roller assembly, mounted at the bottom of the housing;

a charging assembly, mounted in the housing;

a second communication component, mounted in the housing; and a main controller, electrically connected to the roller assembly, the charging assembly, and the second communication component respectively, and configured to control the second communication component to send and receive interactive signals with the debris collecting base station and control a working mode of the cleaning robot based on the interactive signals.

According to another aspect of embodiments of the present disclosure, there is provided a cleaning system. A cleaning system, wherein comprising:

a debris collecting base station, wherein comprising:

a base, provided with a debris intake passageway, wherein one end of the debris intake passageway is configured to pneumatically interface with the debris outlet of the cleaning robot;

a debris collecting device, mounted in the base, wherein the debris collecting device is communicated with another end of the debris intake passageway away from the debris outlet and is configured to extract debris from the cleaning robot and store the extracted debris;

a first communication component, mounted in the base; and a microcontroller, electrically connected to the first communication component and the debris collecting device, and configured to control the first communication component to send and receive interactive signals with the cleaning robot and control an working mode of the debris collecting base station based on the interactive signals; and a cleaning robot configured to cooperate with a dust collecting base station.

According to another aspect of embodiments of the present disclosure, there is provided a cleaning system. A cleaning system, wherein comprising:

a cleaning robot, wherein comprises:

a housing, comprising a receiving cavity;

a debris bin, mounted in a preset position of the receiving cavity, wherein the debris bin is provided with a debris outlet, and the debris bin can discharge debris to the debris collecting base station through the debris outlet;

a roller assembly, mounted at the bottom of the housing;

a charging assembly, mounted in the housing;

a second communication component, mounted in the housing; and a main controller, electrically connected to the roller assembly, the charging assembly, and the second communication component respectively, and configured to control the second communication component to send and receive interactive signals with the debris collecting base station and control a working mode of the cleaning robot based on the interactive signals; and a debris collecting base station, configured to dock with the cleaning robot to extract debris from the cleaning robot and store the extracted debris.

BRIEF DESCRIPTION OF THE DRAWINGS

One or more embodiments are exemplified by the pictures in the corresponding drawings. These exemplified descriptions do not constitute a limitation on the embodiments. Elements with the same reference numerals in the drawings are represented as similar elements. Unless otherwise stated, the figures in the drawings do not constitute a scale limitation.

DETAILED DESCRIPTION

Figure 1:
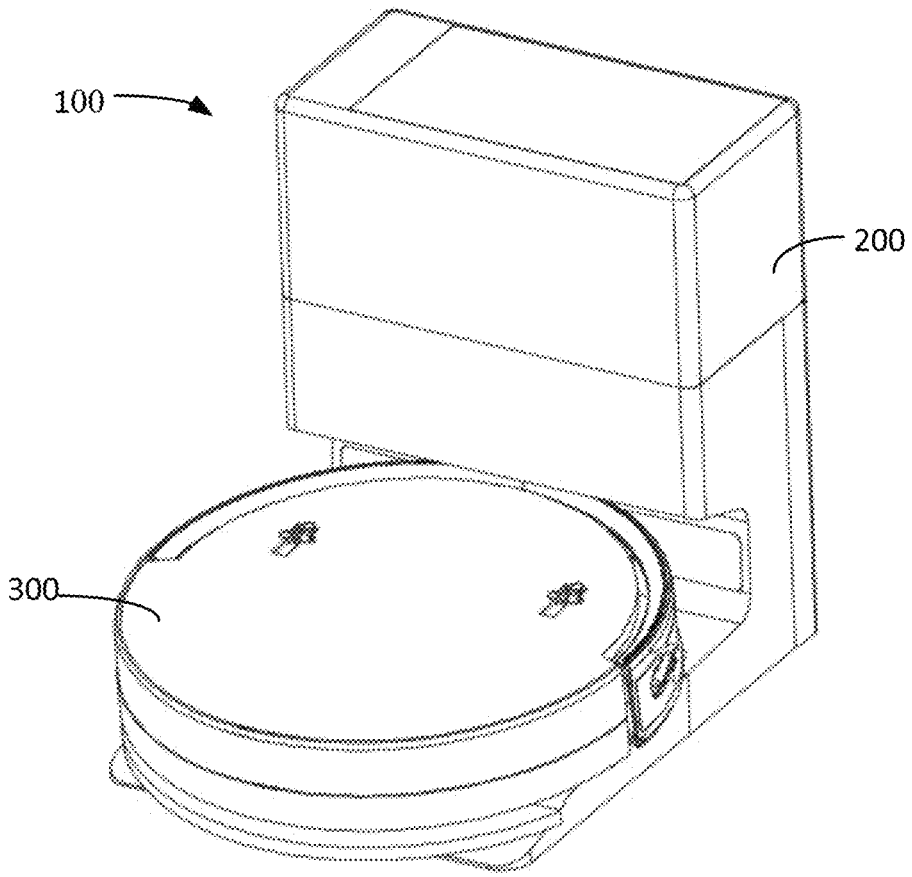
FIG. 1 is a schematic structural diagram of a cleaning system in an embodiment of the present disclosure.

In order to make the objectives, technical solutions and advantages of the present disclosure more clearly, the following further describes the present disclosure in detail with reference to the accompanying drawings and embodiments. It should be understood that the specific embodiments described herein are only configured to explain the present disclosure, but not to limit the present disclosure. Based on the embodiments of the present disclosure, all other embodiments obtained by those of ordinary skill in the art without creative work shall fall within the scope of the present disclosure.

It should be noted that, wherever possible, the various features in the embodiments of the present disclosure can be combined with each other, and all fall within the scope of the present disclosure. In addition, although functional modules are divided in the schematic diagram of the device, and the logical sequence is shown in the flowchart, in some cases, the module may be different from the module division in the drawings, or the shown or described steps may be performed in a sequence different from the sequence shown in the flowchart. Furthermore, the words "first", "second", "third" and the like used in the present disclosure do not limit the data and execution order, but only distinguish the same or similar items with basically the same function and effect.

An embodiment of the present disclosure provides a cleaning system. Please referring to FIG. 1, the cleaning system 100 comprises a debris collecting base station 200 and a cleaning robot 300. The debris collecting base station 200 can establish a wireless communication with the cleaning robot 300 and may send and receive interactive signals with each other. The debris collecting base station 200 or the cleaning robot 300 can control its own working mode based on the interactive signal. It could be understood that the cleaning robot 300 may be any one of a sweeping robot, a sweeping and mopping integrated robot, or a mopping robot, which is not limited herein.

Figure 2:
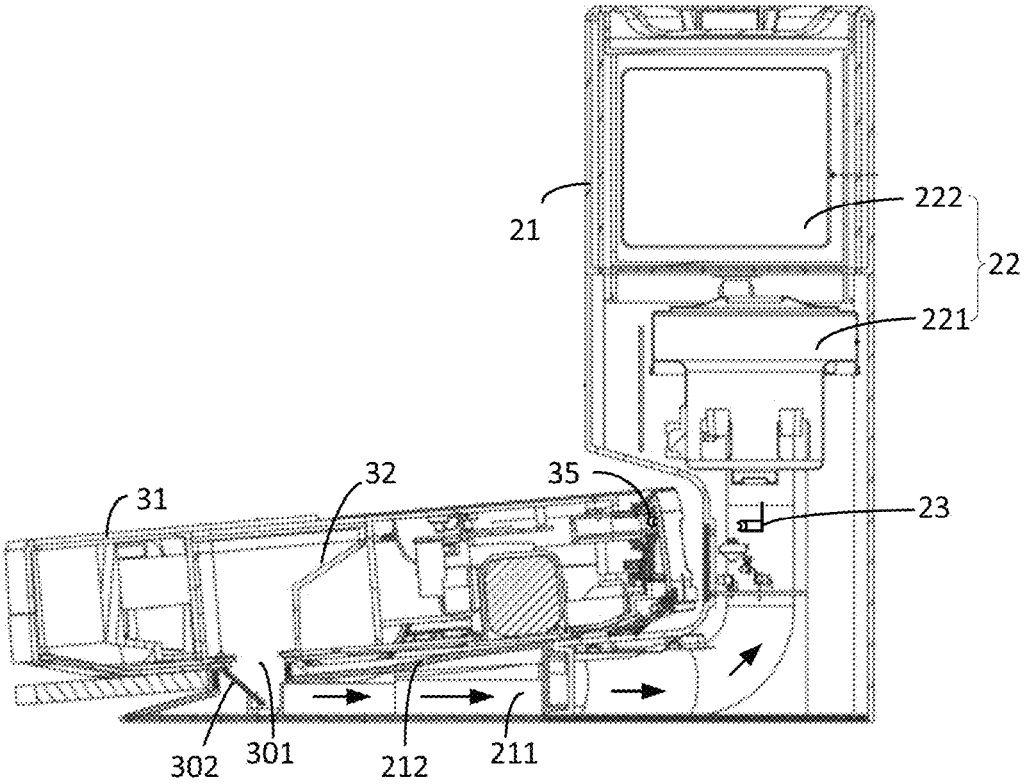
FIG. 2 is a cross-sectional view of the cleaning system shown in FIG. 1, and one end of the debris intake passageway of the debris collecting base station pneumatically interfaces with the debris outlet of the cleaning robot.
Figure 3:
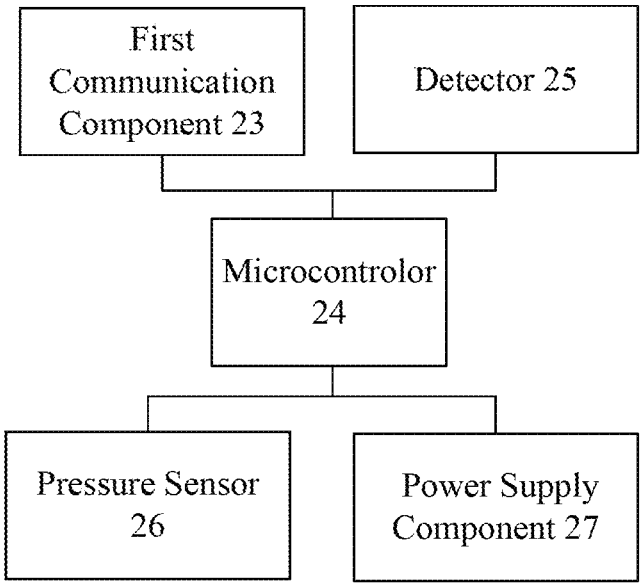
FIG. 3 is a schematic structural diagram of the circuit structure of the debris collecting base station shown in FIG. 1.

Referring to FIG. 2 and FIG. 3, the debris collecting base station 200 comprises a base 21, a debris collecting device 22, a first communication component 23, a microcontroller 24, a detector 25, a pressure sensor 26 and a power supply component 27. In some embodiments, the detector 25 and the pressure sensor 26 can be cancelled.

The base 21 serves as the main structure of the debris collecting base station 200, and its interior is configured to receive various components. The base 21 is provided with a debris intake passageway 211, which extends from the bottom to the top. The cleaning robot 300 has a debris outlet 301 for discharging debris, and one end of the debris intake passageway 211 is configured to pneumatically interface with the debris outlet 301 of the cleaning robot 300, the other end is configured to communicate with the debris collecting device 22. The debris of the cleaning robot 300 is collected by debris collecting device 22 through the debris intake passageway 211.

In some embodiments, it could be understood that the base 21 may be constructed into any suitable shape, such as a cylindrical or approximately "L" shape, etc.

In some embodiments, the base 21 extends horizontally with a bearing part 212 for supporting the cleaning robot 300. The bearing part 212 can effectively limit and fix the cleaning robot 300, so that the debris intake passageway 211 can pneumatically interface with the debris outlet 301 of the cleaning robot 300 accurately and reliably, thereby ensuring the reliable completion of the cleaning work.

It could be understood that, in some embodiments, the base 21 may not need to be provided with the bearing part 212, and the base 21 may adopt the following structure and may also effectively dock with the cleaning robot 300. For example, the base 21 is approximately cylindrical, in which one end of the debris intake passageway 211 is located at the bottom of the base 21, and the cleaning robot 300 directly moves to dock with the bottom of the base 21, so that the debris intake passageway 211 may pneumatically interface with the debris outlet 301 of the cleaning robot 300.

The debris collecting device 22 is mounted in the base 21 and is configured to extract debris from the cleaning robot 300 and store the extracted debris. The debris collecting device 22 can adopt any suitable debris collection principle to collect debris. Accordingly, the user can select any suitable components to design the debris collecting device 22 based on the debris collection principle.

In some embodiments, the debris collecting device 22 comprises a fan assembly 221 and a debris collecting container 222. The fan assembly 221 is mounted in the base 21 and electrically connected to the microcontroller 24. The debris collecting container 222 is mounted in the base 21 and one end of the debris collecting container 222 is in pneumatic communication with another end of the debris intake passageway 211 away from the debris outlet 301, and the other end of the debris collecting container 222 is in pneumatic communication with the fan assembly 221. In one embodiment, the inner cavity of the debris collecting container 222 is in pneumatic communication with the fan assembly 221 and the debris intake passageway 211, and a debris collection bag can be installed in the debris collecting container 222. The opening of the debris collection bag pneumatically interface with the debris intake passageway 211, and the debris collection bag can filter and collect the debris entering from the debris intake passageway 211 into the debris collection bag. The debris collecting container 222 can be fixedly attached to the base 21, or the debris collecting container 222 can be detachably attached to the base 21. In another embodiment, the cavity of the debris collecting container 222 is communicated with the fan assembly 221 and the debris intake passageway 211, and the connection between the debris collecting container 222 and the fan assembly 221 is provided with a filter structure, which is configured to filter the debris, so that the debris entering from the debris intake passageway 211 remains in the inner cavity of the debris collecting container 222.

During operation, the fan assembly 221 generates negative pressure airflow, to draw debris out of the cleaning robot and into the debris intake passageway 211 through the debris outlet 301, and the debris vacuumed by the fan assembly 221 finally enter the debris collecting container 222 through the debris intake passageway 211.

In some embodiments, the fan assembly 221 comprises a support frame and a fan. The support frame is mounted in the base 21, and the fan is mounted on the support frame. One end of the fan is in pneumatic communication with the end of the debris intake passageway 211 away from the debris outlet 301, and the other end is in pneumatic communication with the debris collecting container 222. The fan can cause a negative pressure in the debris intake passageway 211 so as to draw debris into the debris intake passageway 211 through the debris outlet 301.

In some embodiments, the debris collecting container 222 can adopt any suitable debris collection structure, such as a box structure or a bag structure.

The first communication component 23 is configured to communicate with the cleaning robot 300. The debris collecting base station 200 can control the first communication component 23 to send an interactive signal to the cleaning robot 300, and can also receive an interactive signal sent by the cleaning robot 300 by means of the first communication component 23.

In some embodiments, the first communication component 23 comprises any one of communication modules such as an infrared transceiver, a WIF module, a Bluetooth module, a 5G/4G/3G/2G communication module, or a ZEGBEE module. Generally, in order to reduce costs, the debris collecting base station 200 can adopt an infrared transceiver as the communication component. For example, the infrared transceiver comprises a first infrared transmitter and a first infrared receiver, and both the first infrared transmitter and the first infrared receiver are mounted in the base 21 of the debris collecting base station 200. It can be understood that when the cleaning robot 300 adopts an infrared transceiver structure, the first infrared transmitter and the first infrared receiver can be adjusted and mounted corresponding to the mounting position of the infrared transmitter or the infrared receiver of the cleaning robot 300. For example, the infrared transmitter or infrared receiver of the cleaning robot 300 may be mounted on the front end of the cleaning robot 300, and the first infrared transmitter and the first infrared receiver may be mounted on a portion of the base 21 where is near the front end of the cleaning robot 300; the infrared transmitter or the infrared receiver of the cleaning robot 300 may be mounted on the bottom of chassis of the cleaning robot 300, and the first infrared transmitter and the first infrared receiver may be mounted on the bearing part 212 of the base 21.

The first infrared transmitter may send an interactive signal to the cleaning robot, and the first infrared receiver may receive the interactive signal sent by the cleaning robot. The interactive signal may be an infrared light signal. Correspondingly, the cleaning robot 300 may comprise a second communication component 35, wherein the second communication component 35 and the first communication component 23 supports at least the same communication protocol, and the second communication component 35 and the first communication component 23 can communicate with each other.

As the core control logic of the debris collecting base station 200, the microcontroller 24 records the control logic and other business logic corresponding to various working modes.

In some embodiments, the microcontroller 24 may be a logic processing device such as a Single Chip Microcomputer, an ARM processor, a DSP, and the like.

The detector 25 is mounted in the debris collecting container 222 and is electrically connected to the microcontroller 24, so that when the debris collecting container 222 is detected in a debris full state by the detector 25, a debris full signal is generated. The interactive signal comprises the debris full signal, and the working mode of the debris collecting base station 200 comprises a stop mode. The debris full signal is configured to indicate that the debris collecting container 222 is in a full load state, and the stop mode is configured to instruct the debris collecting base station 200 to stop debris extraction operation.

In this embodiment, the microcontroller 24 controls the debris collecting device 22 to enter the stop mode based on the debris full signal, and therefore, the debris collecting device 22 stops working. In addition, the microcontroller 24 controls the first communication component 23 to send a debris full signal to the cleaning robot 300, so that the cleaning robot 300 generates a debris full prompt information based on the debris full signal. For example, the cleaning robot 300 moves to the target room based on the navigation information, and broadcasts the debris full prompt information in the target room through the voice module to remind users in the target room to clean up the debris in the debris collecting container 222 in time, or the cleaning robot 300 uploads the debris full prompt information to the target client terminal through the communication module, so that the user who monitors the target client terminal cleans up the debris in the debris collecting container 222 in time.

The debris full prompt information can be any suitable form of information, such as voice information, prompt light information, text information, etc.

In some embodiments, the detector 25 can include an infrared photoelectric sensor, an ultrasonic sensor, a camera module, or an air pressure sensor. To detect the debris volume of the debris collecting container 222, the detector 25 can send an infrared light signal or an ultrasonic signal or collect the image of the debris collecting container 222 to the microcontroller 24, the microcontroller 24 applying the corresponding algorithm analyze the debris capacity of the debris collecting container based on the feedback infrared light signal or ultrasonic signal or the collected image, so as to detect the debris capacity of the debris collecting container 222. For example, since the amplitude and frequency of the ultrasonic signals reflected by the empty debris collecting container 222 and the fully loaded debris collecting container 222 are different, it can be configured to analyze the debris capacity of the debris collecting container. Alternatively, the detector 25 can detect the air pressure in the debris collecting container 222, and when it detects that the air pressure reaches a preset pressure threshold, it can generate a debris full signal and send the debris full signal to the microcontroller 24.

Generally, the cleaning robot 300 is provided with a debris bin, and the debris bin is detachable attached to the body of the cleaning robot. If the debris bin is not in the preset position of the cleaning robot 300, when the cleaning robot 300 moves to dock with the debris collecting base station 200, if the debris collecting base station 200 performs debris extraction operation on the cleaning robot 300, the debris in the debris bin cannot be extracted, resulting in an invalid debris extraction action.

Therefore, in some embodiments, the cleaning robot 300 can generate a debris bin missing signal when the debris bin is not in the preset position, and send the debris bin missing signal to the debris collecting base station 200. The cleaning robot 300 can detect whether the debris bin is in the preset position by mechanical switch or hall sensor. The interactive signal comprises the debris bin missing signal, the working mode comprises the stop mode, and the debris bin missing signal is configured to indicate that the debris bin is not at the preset position of the robot, such as that the debris bin is missing or arranged in the wrong position of the cleaning robot, so the microcontroller 24 receives the debris bin missing signal of the cleaning robot 300 through the first communication component 23 and controls the debris collecting device 22 to enter the stop mode. Therefore, even if the cleaning robot 300 already move to dock with the debris collecting base station 200, the debris collecting base station 200 will not perform debris extraction operations, thereby protecting the cleaning robot, avoiding useless work, and improving the debris collection effect.

In the same way, when the debris bin is at the preset position, the cleaning robot 300 can generate a debris bin in-position signal based on the debris bin in position, and send the debris bin in-position signal to the debris collecting base station 200. The interactive signal comprises a debris collection start signal and the debris bin in-position signal. The working mode comprises the debris extraction mode, the debris collection start signal is configured to instruct the debris collecting base station 200 to prepare to start the debris extraction operation, the debris bin in-position signal is configured to indicate that the debris bin is at the preset position, and the debris extraction mode is configured to instruct the debris collecting base station 200 to execute the debris extraction operation.

The microcontroller 24 sends the debris collection start signal to the cleaning robot 300 through the first communication component 23, and the cleaning robot 300 generates a response signal based on the debris collection start signal. The response signal is configured to indicate whether the cleaning robot 300 is ready to enter the debris collection state, and the response signal comprises one of the debris bin in-position signal and the debris bin missing signal. When the response signal sent by the cleaning robot 300 to the debris collecting base station 200 is a debris bin in-position signal, the microcontroller 24 receives the response signal through the first communication component 23 and controls the debris collecting device 22 to enter the debris extraction mode. When the response signal sent by the cleaning robot 300 to the debris collecting base station 200 is a debris bin missing signal, the microcontroller 24 receives the response signal through the first communication component 23 and controls the debris collecting device 22 to enter the stop mode.

In this embodiment, the debris collecting base station 200 can selectively perform the debris extraction operation based on whether the debris bin of the cleaning robot 300 is at a preset position, so as to perform the debris collection task reliably and effectively.

The pressure sensor 26 is mounted on the bearing part 212, and the pressure sensor 26 is electrically connected to the microcontroller 24 for detecting the actual pressure applied by the cleaning robot 300 to the bearing part 212.

Based on whether the difference between the actual pressure and the no-load pressure exceeds the preset threshold, if so, the microcontroller 24 controls the first communication component 23 to send a debris collection start signal to the cleaning robot 300. The no-load pressure is the pressure applied by the cleaning robot 300 to the bearing part 212 when the cleaning robot 300 is not loaded with debris. The pressure sensor 26 is located at the position of the bearing part 212 corresponding to wheel grooves which are defined on the bearing part 212 to at least partially accommodate the wheels of the cleaning robot 300, and the weight of the cleaning robot 300 acts on the pressure sensor 26 through the wheels.

In this embodiment, generally, each debris extraction operation of the debris collecting base station 200 executes a default time period. Regardless of the amount of debris in the cleaning robot 300, the debris collecting base station 200 must execute the default time period to collect debris. If the cleaning robot 300 does not load debris or loads a small amount of debris or does not load a debris bin, the debris collecting base station 200 does not need to waste energy to start the debris extraction operation. Therefore, the microcontroller 24 can control the debris collecting device 22 to enter the stop mode when the difference between the actual pressure and the no-load pressure is lower than the preset threshold. The preset threshold can be set based on actual needs.

The power supply component 27 is mounted in the base 21 and is electrically connected to the microcontroller 24, and is configured to align with the charging assembly of the cleaning robot 300 to provide power and generate a charging signal. The microcontroller 24 controls the first communication component 23 to send a debris collection start signal to the cleaning robot 300 based on the charging signal, and the cleaning robot 300 generates a response signal based on the debris collection start signal. As mentioned earlier, the response signal comprises the debris bin in-position signal and the debris bin missing signal. When the response signal sent by the cleaning robot 300 to the debris collecting base station 200 is the debris bin in-position signal, on the one hand, the microcontroller 24 controls the power supply component 27 to provide electric power to the cleaning robot 300, on the other hand, the microcontroller 24 controls the debris collecting device 22 to enter the debris extraction mode. When the response signal sent by the cleaning robot 300 to the debris collecting base station 200 is a debris bin missing signal, the microcontroller 24 controls the power supply component 27 to provide power to the cleaning robot 300 and controls the debris collecting device 22 to enter the stop mode.

In some embodiments, the power supply component 27 comprises electrical contacts and a power conversion circuit. The electrical contacts and the power conversion circuit are electrically connected. the electrical contacts is mounted in the base 21, and when the cleaning robot 300 moves to dock with the base 21, the electrical contacts electrically interface with the charging assembly. The power conversion circuit is electrically connected to the microcontroller, and the microcontroller 24 can control the power conversion circuit to convert the mains power into an output voltage matching the cleaning robot 300, and the output voltage is output to the debris collecting base station 200 through the electrical contacts.

In some embodiments, the interactive signal comprises cleaning history information of the cleaning robot, and the working mode comprises a stop mode, a normal debris extraction mode and/or a strong debris extraction mode. The cleaning history information comprises debris humidity information, cleaning information of the cleaning robot within a preset period, or cleaning planning information. The debris humidity information is configured to indicate the humidity of the debris in the cleaning robot. The cleaning information comprises the total number of cleaning times, and/or the accumulated area of cleaning, and/or the total cleaning time, and/or the cleaned location.

The total number of cleaning times is the number of times the cleaning robot has cleaned during the time period between the latest debris discharge operation time point and the current time, and the accumulated cleaning area is the total cleaning area of the cleaning robot during the time period between the latest debris discharge operation time point and the current time, the total cleaning time is the difference between the latest debris discharge operation time point and the current time, and the cleaned location is the location where the cleaning robot has been cleaning during the time period between the last debris discharge operation time point and the current time.

Each working mode comprises at least one working parameter, and at least one working parameter comprises debris extraction time, and/or debris extraction power, and/or debris extraction times. Any one or more of the operating parameters of the strong debris extraction mode is greater than the corresponding working parameter of the normal debris extraction mode. The user can set any one or more working parameters of the strong debris extraction mode on the software interface of the mobile terminal; or, any one or more working parameters of the strong debris extraction mode can be default parameters and cannot be replaced. The strong debris extraction mode can adopt longer debris extraction time, and/or greater debris extraction power, and/or more debris extraction times.

In some embodiments, the microcontroller 24 may control the debris collecting device 22 to enter one of a stop mode, a normal debris extraction mode, or a strong debris extraction mode based on the cleaning history information.

Generally, the higher the humidity of the debris, the more likely the debris is to agglomerate and not be easily extracted by the debris collecting device 22, and it is easy to stick to the debris bin 32 of the cleaning robot 300, which greatly affects debris collection ability of the cleaning robot 300. When the debris collecting base station 200 extracts debris from the cleaning robot 300, if the normal debris extraction mode is adopted for debris extraction, on the one hand, it takes more time to extract enough amount of debris, which greatly affects the debris collection effect; on the other hand, since the debris collecting base station 200 usually works in the default debris collection time period, the debris collecting base station 200 stops collecting debris when the default debris collection time period is reached, however, some of the dust and debris may still left in the debris bin of the cleaning robot, which is prone to corruption and odor, and reduces the debris collection effect.

Therefore, in some embodiments, if the cleaning history information comprises the debris humidity information, when the humidity signal is greater than or equal to the preset humidity threshold, the microcontroller 24 controls the debris collecting device 22 to enter the strong debris extraction mode. If the humidity signal is less than the preset humidity threshold, the microcontroller 24 controls the debris collecting device 22 to enter the normal debris extraction mode. By adopting the strong debris extraction mode, it can greatly improve the debris collection efficiency. Therefore, selectively adopting the corresponding debris extraction mode based on the humidity of the debris, can reduce the power consumption as much as possible and improve the debris collection efficiency as much as possible, which makes the debris collecting base station 200 and the cleaning robot 300 more intelligent.

Generally, the amount of the debris loaded by the cleaning robot 300 in the frequent cleaning state is different than that in the occasional cleaning state. If the debris collecting base station 200 adopts the same debris extraction mode to roughly extract the debris in the cleaning robot 300 in the above different conditions, there are defects in twits of the debris collection effect and efficiency.

In some embodiments, the microcontroller 24 detects whether the cleaning history information meets the preset debris extraction conditions. If the detection result is yes, the microcontroller 24 controls the debris collecting device to enter one of the strong debris extraction mode and the normal debris extraction mode. If the detection is no, the microcontroller 24 controls the debris collecting device to enter one of the normal debris extraction mode and the stop mode.

In some embodiments, the preset debris extraction conditions comprise: the total number of cleaning times exceeds the preset number of cleaning times, and/or the accumulated cleaning area exceeds the preset cleaning area, and/or the total cleaning time exceeds the preset cleaning time, and/or the cleaned location includes a preset cleaning area.

For example, the cleaning robot 300 did not perform any debris discharge operations but performed 6 cleaning operations from September 9th to September 16th. The cleaning robot 300 discharged debris on September 9, and the preset number of cleaning times is 3. Since the cleaning robot 300 frequently cleans but does not discharge debris, the cleaning robot 300 will accumulate a lot of debris. Therefore, when the cleaning robot 300 dock with the debris collecting base station to discharge debris on September 17, the debris collecting base station 200 automatically selects the strong debris extraction mode to perform debris extraction operation on the cleaning robot 300.

For example, the cleaning robot 300 did not perform any debris discharge operation but performed cleaning work in the kitchen between September 9 and September 16, and the kitchen matches the preset cleaning area, so the debris collecting base station 200 selects the strong debris extraction mode to perform the debris extraction operation on the cleaning robot 300.

Therefore, in this manner, the debris collecting base station 200 and the cleaning robot 300 form a good interaction, so that various situations can be distinguished in a more fine-grained manner, and the corresponding working mode can be selected for debris collection based on the corresponding situation, so as to achieve the effect of intelligent debris collection.

Generally, since the debris collecting base station 200 has a time limit for each debris collection, for example, each debris collection time period is 10 seconds or 15 seconds. After the debris collection time period, the charging assembly of the cleaning robot is in a reset state. In order to achieve multiple debris collection so as to be able to clean up the debris of the cleaning robot 300, the debris collecting base station 200 may adopt a false power-off signal mode to collect debris.

In some embodiments, the interactive signal comprises a false power-off signal. When the debris collecting device 22 finishes a single debris extraction, the microcontroller 24 can control the first communication component 23 to send a false power-off signal to the cleaning robot 300, so that the cleaning robot 300 will first disconnect with the power supply component 27 and then reconnect with the power supply component 27 based on the false power-off signal. In this way, the microcontroller 24 can be triggered again to send the debris collection start signal to the cleaning robot 300 through the first communication component 23 to realize debris collection again. If it is necessary to increase the debris extraction times, the microcontroller 24 can control the first communication component 23 to send false power-off signals to the cleaning robot 300 for several times, which can trigger multiple debris extraction actions to increase the debris extraction times, so that the debris collecting base station 200 can effectively clean up the debris in the cleaning robot 300. In one embodiment, the user can directly select the debris extractions times on the software interface of the user terminal or on the physical button of the debris collecting base station 200, so that the microcontroller 24 can control the first communication component 23 to send false power-off signals to the cleaning robot 300 for several times, so that the debris collecting base station 200 performs continuous debris extraction for the cleaning robot 300. In another embodiment, in the strong debris extraction mode, the user can set the debris extraction times to N times on the software interface of the mobile terminal, and N is a positive integer, so that the microcontroller 24 can control the first communication component 23 to send false power-off signals to the cleaning robot 300 based on the settled debris extraction times, so that the debris collecting base station 200 performs continuous debris extraction for the cleaning robot 300.

Figure 4:
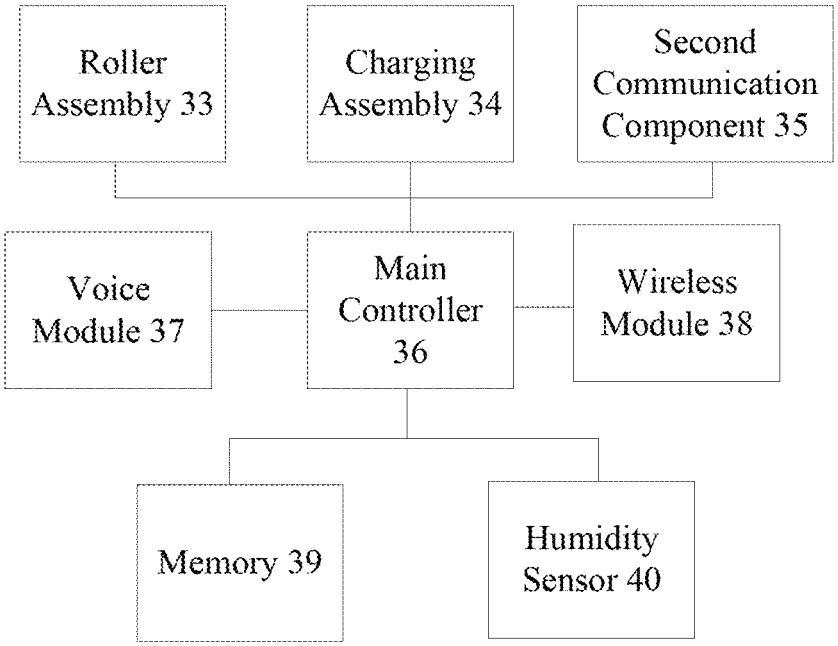
FIG. 4 is a schematic structural diagram of the circuit structure of the cleaning robot shown in FIG. 1.

As mentioned above, the cleaning robot 300 cooperates and interacts with the debris collecting base station 200 to complete the switching of the corresponding working modes. Referring to FIG. 2 and FIG. 4, the cleaning robot 300 comprises a housing 31, a debris bin 32, a roller assembly 33, a charging assembly 34, a second communication component 35, a main controller 36, a voice module 37, a wireless module 38, a memory 39 and a humidity sensor 40.

The housing 31 is a protective shell of the cleaning robot 300, which is provided with a receiving cavity for receiving and mounting various components. In some embodiments, the outer shape of the housing 31 may be substantially elliptical, triangular, D-shaped, or other shapes.

The debris bin 32 is mounted in the preset position of the receiving cavity and is configured to receive the debris collected by the cleaning robot 300. The debris bin 32 is provided with a debris outlet 301, and the debris can be discharged through the debris outlet 301 and into the debris collecting base station 200. In some embodiments, a rubber cover 302 is provided at the debris outlet 301, and the rubber cover is configured to open or close the debris outlet 301. When the debris collecting base station 200 is docked with the cleaning robot 300, one end of the debris intake passageway 211 of the debris collecting base station 200 hits the rubber cover to be open, so that the debris bin 32 is communicated with the debris intake passageway 211 to permit debris to flow through the debris outlet 301 and into the debris collecting base station 200. In other embodiments, when the debris collecting base station 200 is docked with the cleaning robot 300, the debris collecting base station 200 provide negative air pressure to open the rubber cover. The rubber cover can also be replaced by plastic cover or metal cover.

In some embodiments, the debris bin 32 has a suitable shape such as a square or a round shape.

The roller assembly 33 is mounted at the bottom of the housing 31 for driving the cleaning robot 300 to walk.

In some embodiments, the roller assembly 33 comprises a left driving wheel, a right driving wheel and an omni-directional wheel. The left driving wheel and the right driving wheel are respectively mounted on opposite sides of the housing. The left drive wheel and the right drive wheel are configured to at least partially protrude from the bottom of the housing. The omni-directional wheel is mounted at the front position of the bottom of the housing. The omni-directional wheel is a movable caster wheel that can rotate 360 degrees horizontally, so that the cleaning robot can flexibly turn. The mounting of the left driving wheel, the right driving wheel and the omni-directional wheel forms a triangle to improve the walking stability of the cleaning robot. In some embodiments, the omni-directional wheel can be omitted, and only the left and right drive wheels may drive the cleaning robot to walk normally.

The charging assembly 34 is mounted in the housing. After the cleaning robot 300 moves to dock with the debris collecting base station 200, the charging assembly 34 is aligned with the power supply component 27, and the power supply can charge the cleaning robot 300 through the power supply component 27 and the charging assembly 34.

In some embodiments, the charging assembly 34 comprises charging contacts and a power processing circuit, the charging contacts is electrically connected to the power processing circuit, the main controller 36 is electrically connected to the power processing circuit, and the power supply is transmitted to the power processing circuit through the charging contacts. The main controller 36 controls the power processing circuit to convert the power supply into a suitable voltage for storage and supply to other power-consuming components.

In some embodiments, the power processing circuit comprises a voltage conversion circuit and a battery. The main controller 36 is electrically connected to the voltage conversion circuit and the battery respectively, and the voltage conversion circuit is electrically connected to the charging contacts. The voltage conversion circuit is configured to reduce the voltage of the power supply and store the reduced voltage in the battery. The main controller 36 collects the voltage of the battery and controls the working state of the voltage conversion circuit based on the voltage of the battery.

The second communication component 35 is mounted in the housing 31. The second communication component 35 and the first communication component 23 support at least the same communication protocol. When the first communication component 23 adopts an infrared transceiver, the second communication component 35 comprises a second infrared transmitter and a second infrared receiver, and the second infrared transmitter and the second infrared receiver are both mounted in the housing 31, and the second infrared transmitter and the first infrared receiver are mounted at the same height, that is, on the same plane. The second infrared receiver and the second infrared transmitter are mounted at the same height, that is, on the same plane. The second infrared transmitter may send an interactive signal to the debris collecting base station 200, and the second infrared receiver may receive the interactive signal sent by the debris collecting base station 200.

In some embodiments, a front collision plate is moveable mounted in front of the housing 31, and the front collision plate is configured to buffer the collision between the cleaning robot 300 and the obstacle ahead. The front collision plate is provided with a light-transmitting area. The second communication component 35 comprises a second infrared transmitter and a second infrared receiver. The second infrared transmitter and the second infrared receiver are mounted on the side of the front collision plate adjacent to the debris bin and aligned with the light-transmitting area. The infrared signal of the second infrared transmitter can be transmitted to the external environment through the light-transmitting area, and the external infrared signal can be transmitted into the cleaning robot 300 through the light transmitting area and received by the second infrared receiver.

The main controller 36 is electrically connected to the roller assembly 33, the charging assembly 34, the second communication component 35, the voice module 37, the wireless module 38, the memory 39 and the humidity sensor 40, respectively.

As the core control logic of the cleaning robot 300, the main controller 36 records the control logic and other business logic corresponding to various working modes. In this embodiment, the main controller 36 can control the second communication component 35 to send and receive interactive signals with the debris collecting base station 200, and control the working mode of the cleaning robot 300 based on the interactive signals.

In some embodiments, the working mode comprises a debris-full prompt mode, the interactive signal comprises a debris full signal, and the debris full signal is configured to indicate that the debris collecting base station 200 is in a debris full state. The main controller 36 receives the debris full signal sent by the debris collecting base station 200 through the second communication component 35, and generates debris full prompt information based on the debris full signal.

In some embodiments, when the cleaning robot 300 generates the debris full prompt information, the main controller 36 controls the voice module 37 to broadcast the debris full prompt information based on the debris full signal. For example: the cleaning robot 300 moves to the target room based on the navigation information, and broadcasts the debris full prompt information in the target room through the voice module to remind users in the target room to clean up the debris in the debris collecting container 222 in time.

In some embodiments, based on the debris full signal, the main controller 36 controls the wireless module 38 to upload the debris full prompt information to the target device, or the main controller 36 controls the voice module 37 to broadcast the debris full prompt information and controls the wireless module 38 to upload the debris full prompt information to the target device at the same time. The debris full prompt information can be any suitable form of information, such as voice information, prompt light information, text information, etc.

In some embodiments, the voice module 37 comprises an electroacoustic transducer. The electroacoustic transducer employs a voice output device such as a speaker or loudspeaker.

In some embodiments, the wireless module 38 can be a communication module that supports any suitable wireless communication protocol, such as a Bluetooth module, a Wi-Fi module, a GSM module, a 6G to 1G module, or a Zegbee module.

The memory 39 stores the cleaning history information of the cleaning robot 300 within a preset period. As described above, the cleaning history information includes debris humidity information, cleaning information of the cleaning robot within a preset period or the cleaning planning information. The cleaning information comprises the total number of cleaning times, and/or the accumulated cleaning area, and/or the total cleaning time, and/or the cleaned location.

In this embodiment, the main controller 36 can send the cleaning history information to the debris collecting base station 200 through the second communication component 35, so that the debris collecting base station 200 can adjust the working mode based on the cleaning history information. For example, the humidity sensor 40 is configured to detect the humidity of the debris in the debris bin 32 to generate the debris humidity information, and the main controller 36 sends the debris humidity information to the debris collecting base station 200 through the second communication component 35. When the humidity signal is greater than or equal to the preset humidity threshold, the debris collecting base station 200 controls the debris collecting device 22 to enter the strong debris extraction mode, and when the humidity signal is less than the preset humidity threshold, the debris collecting base station 200 controls the debris collecting device 22 to enter the normal debris extraction mode.

Alternatively, the main controller 36 sends the total number of cleaning times to the debris collecting base station 200 through the second communication component 35. When the total number of cleaning times is greater than or equal to the preset number of cleaning times, the debris collecting base station 200 controls the debris collecting device 22 to enter the strong debris extraction mode, and when the accumulated cleaning area is less than the preset number of cleaning times, the debris collecting base station 200 controls the debris collecting device 22 to enter the normal debris extraction mode or the stop mode.

Alternatively, the main controller 36 sends the accumulated cleaning area to the debris collecting base station 200 through the second communication component 35. When the accumulated cleaning area is greater than or equal to the preset cleaning area, the debris collecting base station 200 controls the debris collecting device 22 to enter the strong debris extraction mode, and when the accumulated cleaning area is less than the preset cleaning area, the debris collecting base station 200 controls the debris collecting device 22 to enter the normal debris extraction mode or the stop mode.

Alternatively, the main controller 36 sends the total cleaning time to the debris collecting base station 200 through the second communication component 35. When the total cleaning time is greater than or equal to the preset cleaning time, the debris collecting base station 200 controls the debris collecting device 22 to enter the strong debris extraction mode, and when the total cleaning time is less than the preset cleaning time, the debris collecting base station 200 controls the debris collecting device 22 to enter the normal debris extraction mode or the stop mode.

Alternatively, the main controller 36 sends the cleaned location to the debris collecting base station 200 through the second communication component 35. When the cleaned location is in the preset cleaning area, the debris collecting base station 200 controls the debris collecting device 22 to enter the strong debris extraction mode, and when the cleaned location is not in the preset cleaning area, the debris collecting base station 200 controls the debris collecting device 22 to enter the normal debris extraction mode. Alternatively, then the cleaned location is not in the preset cleaning area, the debris collecting base station 200 controls the debris collecting device 22 to enter the normal debris extraction mode, and when the cleaned location is in the preset cleaning area, the debris collecting base station 200 controls the debris collecting device 22 to enter the strong debris extraction mode.

For example, the preset cleaning area is the area defined by the user on the software interface of the user terminal. It is the key cleaning area. For example, the user can define the kitchen as the preset cleaning area on the user terminal. It is then sent to the debris collecting base station 200 and the cleaning robot 300 via a wireless network. When the cleaning robot 300 performs cleaning work in the kitchen (collecting more debris), the main controller 36 records the cleaning history in which the cleaning location includes the kitchen area. The kitchen area matches the preset cleaning area. After the cleaning, when the cleaning robot 300 docks with the debris collecting base station 200 to discharge debris, the main controller 36 sends the cleaned location to the debris collecting base station 200 through the second communication component 35. Since the cleaned location matches the preset cleaning area, the debris collecting base station 200 selects the strong debris extraction mode to perform the debris extraction operation on the cleaning robot 300 to quickly collect more debris. Certainly, in other embodiments, the preset cleaning area may also be another area, which can be freely set by the user.

Finally, it should be noted that the above embodiments are only configured to illustrate the technical solutions of the present disclosure, not to limit them; under the idea of the present disclosure, the technical features of the above embodiments or different embodiments can also be combined. The steps can be implemented in any order, and there are many other variations of the different aspects of the present disclosure as described above. For the sake of brevity, they are not provided in details; although the present disclosure has been described in detail with reference to the foregoing embodiments, those of ordinary skill in the art should understand that they can still modify the technical solutions described in the foregoing embodiments, or equivalently replace some of the technical features; however, these modifications or replacements do not depart from the spirit of the corresponding technical solutions of the embodiments of the present disclosure.

What is claimed is:

1. A debris collecting base station, the debris collecting base station is configured to cooperate with a cleaning robot which has a debris outlet for discharging debris, wherein the debris collecting base station comprises:

a base, provided with a debris intake passageway, wherein one end of the debris intake passageway is configured to pneumatically interface with the debris outlet of the cleaning robot;

a debris collecting device, mounted in the base, wherein the debris collecting device is communicated with another end of the debris intake passageway away from the debris outlet and is configured to extract debris from the cleaning robot and store the extracted debris;

a first communication component, mounted in the base; and a microcontroller, electrically connected to the first communication component and the debris collecting device, and configured to control the first communication component to send and receive interactive signals with the cleaning robot and control an working mode of the debris collecting base station based on the interactive signals, wherein the cleaning robot comprises a debris bin, wherein the cleaning robot is able to generate a debris bin missing signal when the debris bin is not in a preset position;

wherein the signals comprise the debris bin missing signal, and the working mode comprises a stop mode;

wherein the microcontroller receives the debris bin missing signal of the cleaning robot through the first communication component, and controls the debris collecting device to enter the stop mode.

2. The debris collecting base station according to claim 1, wherein the debris collecting device comprises:

a fan assembly, mounted in the base and electrically connected to the microcontroller;

a debris collecting container, mounted in the base and pneumatically communicated with the another end of the debris intake passageway away from the debris outlet and pneumatically communicated with the fan assembly.

3. The debris collecting base station according to claim 2, wherein, the interactive signals comprise a debris full signal;

wherein the debris collecting base station further comprises a detector, which is mounted in the debris collecting container and electrically connected to the microcontroller to generate a debris full signal when detecting that the debris collecting container is in a debris full state;

wherein the microcontroller controls the debris collecting device to enter the stop mode in response the debris full signal, and controls the first communication component to send the debris full signal to the cleaning robot, so that the cleaning robot can generate the debris full prompt information based on the debris full signal.

4. The debris collecting base station according to claim 1, wherein the cleaning robot can generate a debris bin in-position signal based on the presence of the debris bin;

wherein the interactive signals comprise a debris collection start signal and the debris bin in-position signal, and the working mode comprises a debris extraction mode;

wherein after the microcontroller sends the debris collection start signal to the cleaning robot through the first communication component, the microcontroller receives a response signal of the cleaning robot through the first communication component, and if it is detected that the response signal comprises the debris bin in-position signal, the debris collecting device is controlled to enter the debris extraction mode.

5. The debris collecting base station according to claim 4, wherein the base extends horizontally with a bearing part configured to support the cleaning robot;

wherein the debris collecting base station further comprises a pressure sensor, which is mounted on the bearing part and electrically connected to the microcontroller to detect an actual pressure applied to the bearing part by the cleaning robot;

wherein the microcontroller detects whether a difference between the actual pressure and the no-load pressure exceeds a preset threshold, if yes, the microcontroller controls the first communication component to send the debris collection start signal to the cleaning robot, wherein a no-load pressure is the pressure applied to the bearing part by the cleaning robot when the cleaning robot is not loaded with debris.

6. The debris collecting base station according to claim 4, wherein the debris collecting base station comprises a power supply component, which is mounted in the base and electrically connected to the microcontroller and configured to align with a charging assembly of the cleaning robot to provide electric energy and generate a charging signal;

wherein the microcontroller controls the first communication component to send the debris collection start signal to the cleaning robot based on the charging signal.

7. The debris collecting base station according to claim 6, wherein the interactive signals further comprise a false power-off signal;

wherein when the debris collecting device finishes a single debris extraction, the microcontroller can control the first communication component to send the false power-off signal to the cleaning robot, so that the cleaning robot will first disconnect with the power supply component and then reconnect with the power supply component based on the false power-off signal.

8. The debris collecting base station according to claim 1, wherein the interactive signals further comprise cleaning history information of the cleaning robot, and the working modes further comprise a normal debris extraction mode and/or a strong debris extraction mode, wherein each of the working modes comprises at least one working parameter, and the at least one working parameter comprises a debris extraction time, and/or a debris extraction power, and/or debris extraction times, and any one or more of the working parameters of the strong debris extraction mode is greater than the corresponding working parameters of the normal debris extraction mode;

wherein the microcontroller controls the debris collecting device to enter one of the stop mode, the normal debris extraction mode, and the strong debris extraction mode based on the cleaning history information.

9. The debris collecting base station according to claim 8, wherein, the cleaning history information comprises debris humidity information for indicating the humidity of the debris of the cleaning robot;

wherein when the humidity information is greater than or equal to a preset humidity threshold, the microcontroller controls the debris collecting device to enter the strong debris extraction mode;

wherein when the humidity signal is less than the preset humidity threshold, the microcontroller controls the debris collecting device to enter the normal debris extraction mode.

10. The debris collecting base station according to claim 8, wherein the cleaning history information is the cleaning information of the cleaning robot in a preset period, and the cleaning history information comprises a total number of cleaning times, and/or an accumulated cleaning area, and/or a total cleaning time, and/or a cleaned location.

11. The debris collecting base station according to claim 10, wherein, the microcontroller detects whether the cleaning history information meets a preset debris extraction condition, and the preset debris extraction condition comprises: the total number of cleaning times exceeds a preset number of cleaning times, and/or the accumulated cleaning area exceeds a preset cleaning area, and/or the total cleaning time exceeds the preset cleaning time, and/or the cleaned location comprises a preset cleaning area, if so, the microcontroller controls the debris collecting device to enter one of the strong debris extraction mode and the normal debris extraction mode.

12. A cleaning robot, configured to cooperate with a debris collecting base station, wherein the cleaning robot comprises:

a housing, comprising a receiving cavity;

a debris bin, mounted in a preset position of the receiving cavity, wherein the debris bin is provided with a debris outlet, and the debris bin can discharge debris to the debris collecting base station through the debris outlet;

a roller assembly, mounted at a bottom of the housing;

a charging assembly, mounted in the housing;

a second communication component, mounted in the housing; and a main controller, electrically connected to the roller assembly, the charging assembly, and the second communication component respectively, and configured to control the second communication component to send and receive interactive signals with the debris collecting base station and control a working mode of the cleaning robot based on the interactive signals, wherein the cleaning robot further comprises a memory that is electrically connected to the main controller and stores cleaning history information of the cleaning robot in a preset period, wherein the main controller sends the cleaning history information to the debris collecting base station through the second communication component, so that the debris collecting base station adjusts the working mode based on the cleaning history information, wherein the cleaning robot comprises a debris bin, wherein the cleaning robot is able to generate a debris bin missing signal when the debris bin is not in a preset position;

wherein the signals comprise the debris bin missing signal, and the working mode comprises a stop mode;

wherein the second communication component is configured to send the debris bin missing signal of the cleaning robot to a microcontroller of the debris collecting base station through a first communication component, so that the microcontroller controls a debris collecting device to enter the stop mode.

13. The cleaning robot according to claim 12, wherein the working mode further comprises a debris-full prompt mode, and the interactive signals further comprise a debris full signal which is configured to indicate that the debris collecting base station is in a debris full state;

wherein the main controller receives the debris full signal sent by the debris collecting base station through the second communication component, and generates debris full prompt information based on the debris full signal.

14. The cleaning robot according to claim 13, wherein the cleaning robot further comprises at least one of a voice module and a wireless module, wherein when the cleaning robot comprises the voice module, the voice module is electrically connected to the main controller, and the main controller controls the voice module to broadcast the debris full prompt information based on the debris full signal; and wherein when the cleaning robot comprises the wireless module, the main controller controls the wireless module to upload the debris full prompt information to a target device based on the debris full signal.

15. The cleaning robot according to claim 12, wherein the cleaning history information comprises debris humidity information, and the cleaning robot comprises a humidity sensor configured to detect a humidity of the debris in the debris bin to generate the debris humidity information.

16. The cleaning robot according to claim 12, wherein the cleaning history information comprises a total number of cleaning times, and/or an accumulated cleaning area, and/or a total cleaning time, and/or a cleaned location.

17. A cleaning system, comprising:

a debris collecting base station, wherein the debris collecting base station comprises:

a base, provided with a debris intake passageway, wherein one end of the debris intake passageway is configured to pneumatically interface with a debris outlet of a cleaning robot;

a debris collecting device, mounted in the base, wherein the debris collecting device is communicated with another end of the debris intake passageway away from the debris outlet and is configured to extract debris from the cleaning robot and store the extracted debris;

a first communication component, mounted in the base; and a microcontroller, electrically connected to the first communication component and the debris collecting device, and configured to control the first communication component to send and receive interactive signals with the cleaning robot and control an working mode of the debris collecting base station based on the interactive signals, and the cleaning robot configured to cooperate with a debris collecting base station, wherein the cleaning robot comprises a debris bin, wherein the cleaning robot is able to generate a debris bin missing signal when the debris bin is not in a preset position;

wherein the signals comprise the debris bin missing signal, and the working mode comprises a stop mode;

wherein the microcontroller receives the debris bin missing signal of the cleaning robot through the first communication component, and controls the debris collecting device to enter the stop mode.

18. A cleaning system, comprising:

a cleaning robot, wherein the cleaning robot comprises:

a housing, comprising a receiving cavity;

a debris bin, mounted in a preset position of the receiving cavity, wherein the debris bin is provided with a debris outlet, and the debris bin can discharge debris to the debris collecting base station through the debris outlet;

a roller assembly, mounted at the bottom of the housing;

a charging assembly, mounted in the housing;

a second communication component, mounted in the housing; and a main controller, electrically connected to the roller assembly, the charging assembly, and the second communication component respectively, and configured to control the second communication component to send and receive interactive signals with the debris collecting base station and control a working mode of the cleaning robot based on the interactive signals; and a debris collecting base station, configured to dock with the cleaning robot to extract debris from the cleaning robot and store the extracted debris;

wherein the debris collecting base station comprises:

a base, provided with a debris intake passageway, wherein one end of the debris intake passageway is configured to pneumatically interface with the debris outlet of the cleaning robot;

a debris collecting device, mounted in the base, wherein the debris collecting device is communicated with another end of the debris intake passageway away from the debris outlet and is configured to extract debris from the cleaning robot and store the extracted debris;

a first communication component, mounted in the base; and a microcontroller, electrically connected to the first communication component and the debris collecting device, and configured to control the first communication component to send and receive interactive signals with the cleaning robot and control an working mode of the debris collecting base station based on the interactive signals, wherein the cleaning robot further comprises a memory that is electrically connected to the main controller and stores cleaning history information of the cleaning robot in a preset period, wherein the main controller send the cleaning history information to the debris collecting base station through the second communication component, so that the debris collecting base station adjusts the working mode based on the cleaning history information, wherein the cleaning robot is able to generate a debris bin missing signal when the debris bin is not in a preset position;

wherein the signals comprise the debris bin missing signal, and the working mode comprises a stop mode;

wherein the microcontroller receives the debris bin missing signal of the cleaning robot through the first communication component, and controls the debris collecting device to enter the stop mode.

* * * * *